US005487426A

United States Patent [19]

O'Hair

[11] Patent Number: 5,487,426

[45] Date of Patent: Jan. 30, 1996

[54] ROD GUIDE WITH REMOVABLE VANES

[75] Inventor: Dan E. O'Hair, Conroe, Tex.

[73] Assignee: Enterra Patco Oilfield Products Inc., Houston, Tex.

[21] Appl. No.: 311,496

[22] Filed: Sep. 23, 1994

[51] Int. Cl.[6] ..... F21B 17/10

[52] U.S. Cl. ..... 166/378; 166/241.4

[58] Field of Search ..... 166/173, 176, 166/241.1, 241.2, 241.4, 241.6, 241.7, 387

[56] References Cited

U.S. PATENT DOCUMENTS

| | | | |
|---|---|---|---|
| 2,602,515 | 7/1952 | Baker et al. | 166/173 |
| 2,754,160 | 7/1956 | Owen | 166/241.2 |
| 3,080,926 | 3/1963 | Remp, Jr. | 166/173 |
| 3,251,418 | 5/1966 | Condra | 166/173 |
| 4,099,564 | 7/1978 | Hutchison | 166/241.1 |
| 4,640,349 | 2/1987 | Allen | 166/241.2 X |
| 5,095,981 | 3/1992 | Mikolajczyk | 166/241.6 |
| 5,339,896 | 8/1994 | Hart et al. | 166/241.2 |
| 5,358,041 | 10/1994 | O'Hair | 166/241.4 |

*Primary Examiner*—Frank S. Tsay
*Attorney, Agent, or Firm*—Gunn & Associates

[57] ABSTRACT

A rod guide with removable vanes provides the capability of using one wear-resistant material for the erodable volume of the rod guide and another, stock material for the body that holds the vanes. When the vanes of the rod guide are expended, they are removed and replaced and the body is reused. In this way, sucker rod segments can be quickly and easily refurbished in the field with significant savings in transport time. High value wear-resistant materials are placed where the wear occurs and the remainder of the rod guide is made of a material that can be used for an extended period of time in the harsh down-hole environment.

12 Claims, 3 Drawing Sheets

ROD GUIDE WITH REMOVABLE VANES

FIELD OF THE INVENTION

The present invention relates generally to the field of rod guides deployed on slicker rods and, more particularly, to a rod guide with a plurality of vanes that may be removed from a rod guide body and replaced with substitute vanes.

BACKGROUND OF THE INVENTION

Rod guides formed or installed on sucker rods in secondary recovery efforts have been used for some time to center the sucker rod within a hole. The sucker rod must extend from a pumping unit all the way down to the reciprocating pump, which may be several thousand feet below the surface. Consequently, the sucker rod is subjected to a variety of stresses: compression, tension, torsion, and bending. Further, the sucker rod can "wobble" or bend within production tubing. This problem of "wobble" or bending has been solved by the installation of rod guides on the sucker rod to centralize the sucker rod within the production tubing thereby controlling rod and tubing wear.

A prior art sucker rod guide includes a body that is molded in intimate contact with the sucker rod. The body has simultaneously molded therewith a plurality of "fins", "blades", or "vanes" that extend radially from the body. As used herein, the terms "fin", "blade", and "vane" refer to the molded portion of the rod guide that extends from the body to guidingly contact the interior surface of production tubing.

As the rod guide is used within the production tubing, the outer extremities of the guide vanes wear away. The total volume of rod guide material that is available for wear (before a coupling is subjected to contact with the interior surface of production tubing) is known as "erodable volume." In one sense, all other factors being equal, the greater the erodable volume, the longer the useful lifetime of the rod guide. Once the vanes wear down to a point to where a coupling between rod guide segments contacts the production tubing, the rod guide must be replaced.

When a rod guide is replaced, the entire material remaining in the rod guide is disposed of, usually a majority of the material from which the rod guide was made. High performance polymers have been used in the past to provide the longest useful lifetime for the rod guide, while maintaining low coefficients of static and dynamic friction and sufficient resistance to failure in high pressure and velocity environments. Such high performance polymers are expensive and it is wasteful to dispose of the unused guide material. Thus, there remains a need for a rod guide in which the majority of rod guide material is not disposed of when the erodable volume has been expended.

Further, as previously described, the rod guide is customarily made of a body, molded in intimate contact with a rod segment, and integrally molded vanes protruding radially therefrom. The rod guide body serves only to secure the vanes which provide the erodable volume. Thus, the rod guide body is not subjected to the same forces and erosion as the vanes and need not be constructed of the same material to satisfy the same design criteria. Therefore, there remains a need for a rod guide in which the rod guide body is made of a commodity material while the vanes of the rod guide are made of a specially formulated material that maximizes erodable volume performance. Further, the rod guide body should be reusable by simply replacing spent vanes. Such a rod guide body should be adaptable to a variety of tubing sizes by simply changing to a vane height specifically designed for a particular tubing application.

SUMMARY OF THE INVENTION

The present invention provides these and other desirable features by incorporating a standard rod guide body that is made of commodity, i.e., off-the shelf material adapted to receive any of a plurality of rod guide vanes. The rod guide vanes may be made of a specially adapted material that more resistant to friction wear than the rod guide body. Further, the vanes may be made of different colors or provide a wear gauge feature to visually indicate when the vanes of the rod guide should be replaced. A single rod guide body is adapted to receive a variety of vane sizes so that a single tooling for the rod guide body accommodates any of the standard production tubing inside diameters. All of the factors reduces tooling and production costs and enhances the adaptability of the rod guide to a variety of down-hole conditions.

These and other features and objects of the present invention will be apparent to those of skill in the art from a review of the following detailed description and drawing figures.

DETAILED DESCRIPTION OF A PREFERRED EMBODIMENT

Figure 1:
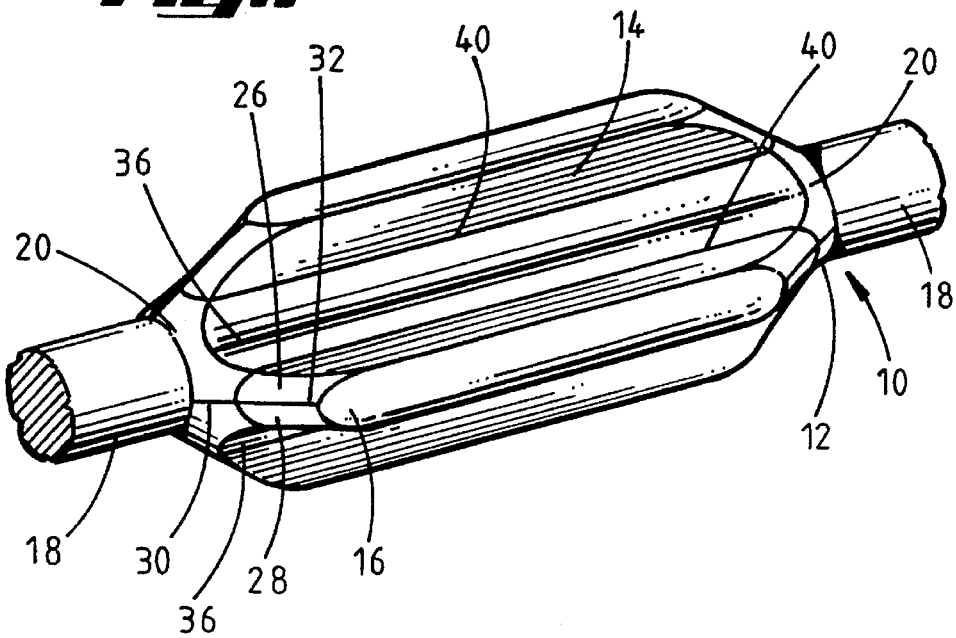
FIG. 1 is a perspective view of a rod guide with detachable vanes of the present invention shown in an assembled state.

FIG. 1 depicts a rod guide of the present invention. The rod guide, designated generally as 10, comprises a body 12 and a plurality of removable vanes 14 and 16. The body is preferably molded to a rod segment 18 in intimate contact with the rod segment in one or more injection steps.

The body 12 includes a substantially conical end portion 20 on one end and a substantially conical end portion 22 on the other end to minimize drag and turbulence as the rod guide moves up and down within production tubing. Each removable vane 14, 16 has a leading edge 24 which preferably includes a knife edge formed of surfaces 26 and 28 to also minimize adverse hydraulic effects within the piping. The leading edge of the removable vane 14, 16 may alternatively form a substantially monoplanar surface as desired. A leading edge 30 flows smoothly in shape from a knife edge 32 between the surfaces 26 and 28. While the previously described shapes of the surfaces 26 and 28 and the edges 30 and 32 are preferred, other shapes and configurations will be apparent to those of skill in the art and fully within the scope and spirit of the present invention.

Figure 4:
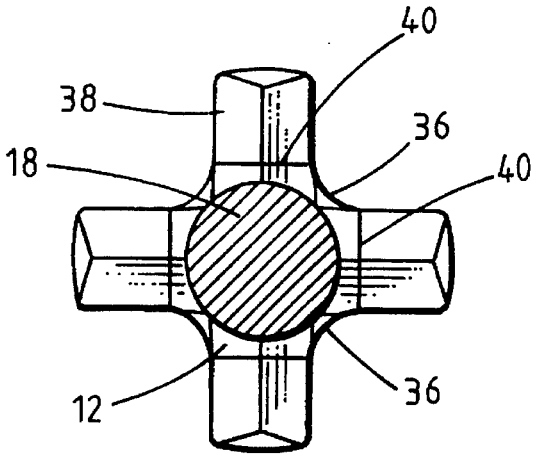
FIG. 4 is an end view of the rod guide of FIG. 3.

As shown in FIG. 4, the body 12 may form concave surfaces 36 in areas between removable vanes 38. Alternatively, the body may be substantially cylindrically shaped between the removable vanes, so long as sufficient bypass area is provided between the production tubing and the rod guide. The body 12 and the vanes 38 abut at a seam 40 and the exterior surfaces of the vanes and the body flow smoothly together.

Returning to FIG. 1, the leading and trailing edges of the removable vanes 14 and 16 smoothly abut with the substantially conical portions 20 and 22 at the seams 40. This provides the desired hydrodynamic configuration to minimize drag and turbulence.

Figure 2:
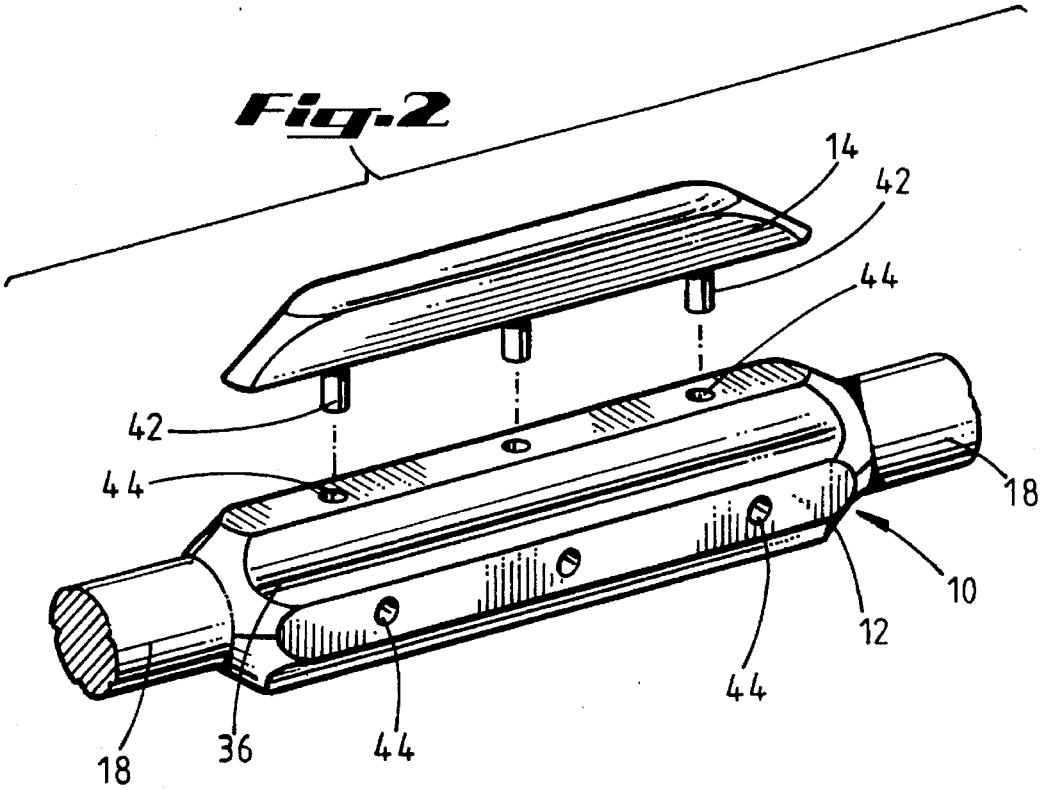
FIG. 2 is a perspective view of the rod guide showing the vanes removed and showing how one such detachable vane may be fitted to a standard body.

FIG. 2 shows an exploded view of the rod guide 10. In FIG. 2, the removable vane 14 is lifted to reveal its mounting to the body 12 and the vane 16 has been totally removed. In a preferred embodiment, the vane 14 has a plurality of anchoring elements 42 molded thereon. In the embodiment of FIG. 2, the anchoring elements 42 comprise posts extending radially from the axis of the rod segment. The anchoring elements 42 fit snugly, as by a press fit, into matching holes 44. The anchoring elements 42 must fit into the holes 44 with sufficient tightness to withstand downhole pressure and velocity as the rod guide moves within the tubing, which may be referred to as the PV product. Rather than being molded as an integral part of the vane 14, the anchoring elements 42 may be formed of a stock polymer dowel and fitted into similar holes in the vane 14 as well as the holes 44. The anchoring elements are preferably not molded as a part of the body 12 since it is anticipated that, in removing and replacing the removable vanes, that the anchoring elements will be broken, perhaps intentionally. In fact, in removing the vanes, the preferred method of using the present invention is to grasp and remove the vanes by a radial pull, or to simply knock the vanes off by a sharp blow to the side of each vane tangentially of the axis of the rod 18. Polymer material may thus be left behind in the holes 44, which can easily and quickly drilled out to place the body 12 in condition to receive a new set of vanes.

Figure 3:
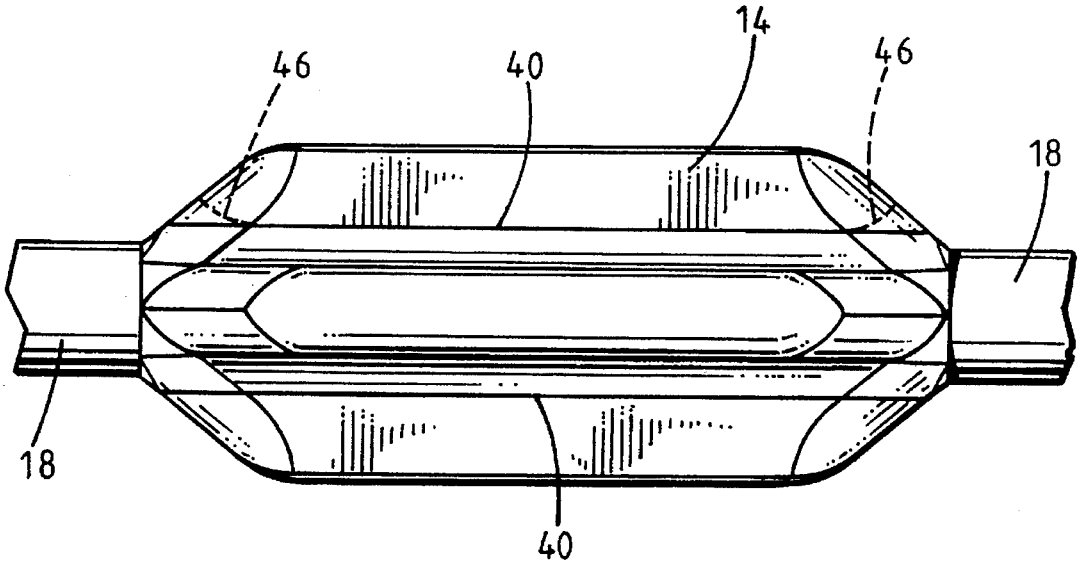
FIG. 3 is a side view of the rod guide with the vanes attached showing alternative contact surfaces between the guide body and the vanes.

Referring to FIG. 3, the seam 40 is illustrated as formed of two planes. While this is preferred for ease of design, construction, and assembly, the seam may curve to meet the forward and trailing edges of the vanes at a normal to this surface, shown as a dashed line 46 in FIG. 3, or form any desired and appropriate shape. This embodiment is not preferred, however, since it reduces the amount of erodable volume because, as the vanes wear down, the body of the rod guide will be more quickly exposed to wear.

Figure 5:
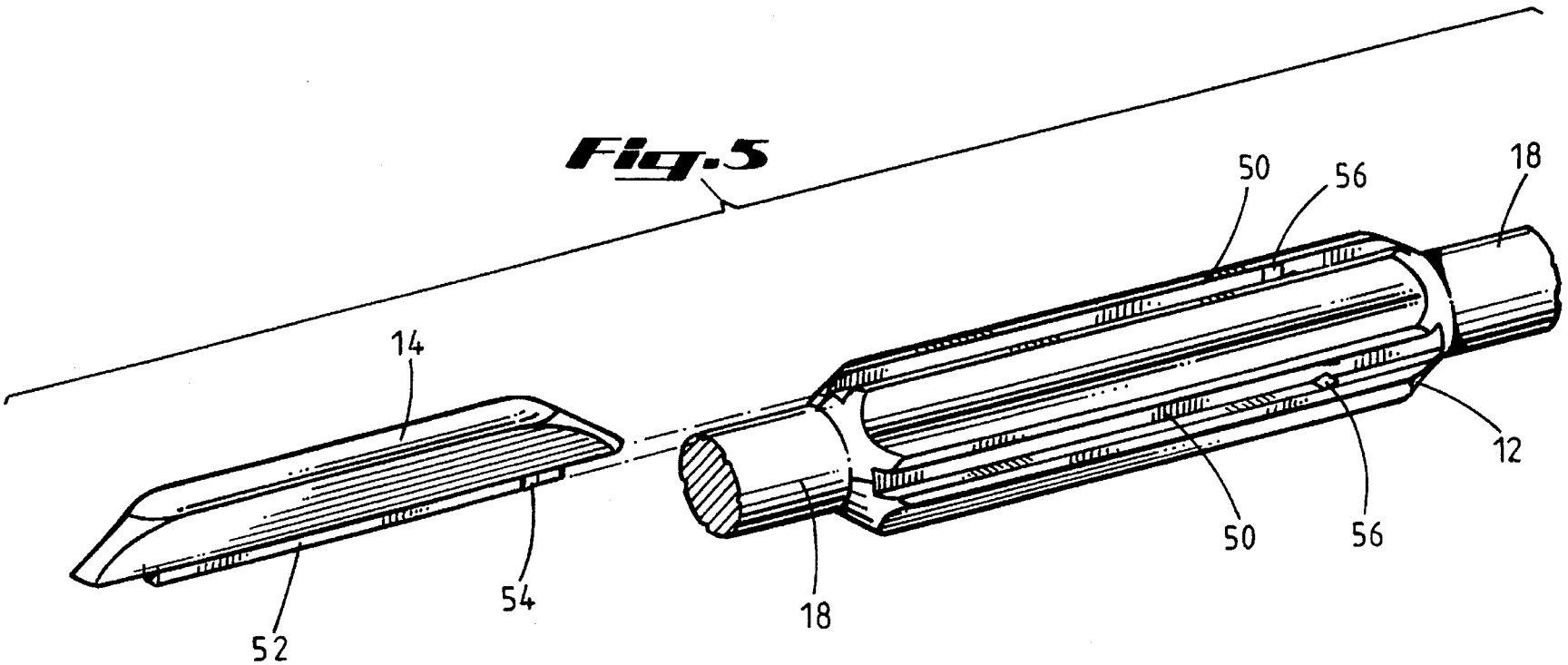
FIG. 5 is a perspective view of a rod guide of the present invention showing an alternative embodiment of a means of attaching a vane to a rod guide body.

FIG. 5 depicts an alternative means of anchoring the removable vanes to the body 12. In this embodiment, the body has formed therein a plurality of slots 50. Each slot 50 mates with an anchor element 52, in this case an elongated runner that snugly fits into one of the slots 50. The embodiment may also be described as a tongue-in-groove arrangement.

Formed on either side of the runner 52 is a wedge lock 54 which limits the travel of the runner 52 into the slot 50 and securely holds the runner 52 in place, yet permits the removal of the removable vane 14 to the left as seen in FIG. 5. The slot 50 includes a mating wedge lock latch 56 to receive the wedge lock 54.

The slot 50 and runner 52 combination itself may be formed as a wedge arrangement to facilitate assembly while providing a secure fit. In this embodiment, it is expected that the runner 52 will remain intact on the vane 14 when the vane 14 is removed and eliminate the need to remove any material left behind in the body 12. However, this embodiment requires the molding of more material into the vane 14 and runner 52 combination and may slightly increase the cost of material that goes into the vane.

The principles, preferred embodiments, and modes of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A rod guide comprising:

a. a rod guide body made of a first polymeric material;

b. a plurality of vanes made of a second polymeric material; and c. a plurality of anchoring elements detachably coupling the vanes directly to the body such that the vanes remain stationary in relation to the body while the vanes are anchored to the body.

2. The rod guide of claim 1 wherein the first polymeric material is a different material than the second polymeric material.

3. The rod guide of claim 2 wherein the body is formed of a stock polymeric material and the vanes are formed of a polymeric material specially adapted to resist friction wear.

4. The rod guide of claim 1 wherein the first polymeric material is the same as the material than the second polymeric material.

5. The rod guide of claim 1 wherein the first polymeric material is a different color than the second polymeric material.

6. The rod guide of claim 1 wherein each of the anchoring elements is molded as a unitary piece with one of the vanes.

7. The rod guide of claim 6 wherein an anchoring element comprises a runner and further comprising a slot in the body adapted to the receive the runner.

8. The rod guide of claim 7 wherein the runner forms a wedge and further comprising a wedge lock on the runner.

9. The rod guide of claim 1 wherein the anchoring elements comprise a plurality of posts extending between the vanes and the body.

10. The rod guide of claim 9 further comprising a plurality of holes in the body to receive the posts.

11. The rod guide of claim 9 further comprising a plurality of holes in the vanes to receive the posts.

12. A method of forming a rod guide comprising the steps of:

a. molding a body to a sucker rod segment, the body adapted to receive a plurality of vanes;

b. separately molding a plurality vanes; and c. detachably anchoring the vanes directly to the body such that the vanes remain stationary in relation to the body while the vanes are anchored to the body.

* * * * *